US006679241B2

(12) United States Patent
Proctor

(10) Patent No.: US 6,679,241 B2
(45) Date of Patent: Jan. 20, 2004

(54) ARROW REST

(76) Inventor: Robert G. Proctor, 36004 Jacks Canyon Rd., Lenore, ID (US) 83541

( * ) Notice: Subject to any disclaimer, the term of this patent is extended or adjusted under 35 U.S.C. 154(b) by 0 days.

(21) Appl. No.: 10/253,951

(22) Filed: Sep. 24, 2002

(65) Prior Publication Data

US 2003/0062034 A1 Apr. 3, 2003

Related U.S. Application Data

(60) Provisional application No. 60/325,798, filed on Sep. 28, 2001.

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS 5,490,491 A * 2/1996 Troncoso ..... 124/44.5
5,535,728 A * 7/1996 Prodigo ..... 124/44.5
5,555,875 A * 9/1996 Martin et al. ..... 124/44.5
5,673,678 A * 10/1997 Savage ..... 124/44.5
6,050,251 A * 4/2000 Harwath et al. ..... 124/44.5

* cited by examiner

*Primary Examiner*—John A. Ricci
(74) *Attorney, Agent, or Firm*—Brian C. Trask

(57) ABSTRACT

An arrow rest for use with an archery bow. The arrow rest includes a shelf mountable to a bow for shelf orientation transverse to an arrow flight direction; one or more launcher arms affixed to the shelf for transverse windage adjustment; and an arrow glide supported by the launcher arm(s) arranged to support an arrow. The arrow rest may, in part, be assembled in a tool-free operation to create a self-biased friction fit between a launcher arm and the shelf. A resilient portion of the arrow rest absorbs arrow vibrations to reduce noise and improve arrow flight.

20 Claims, 5 Drawing Sheets

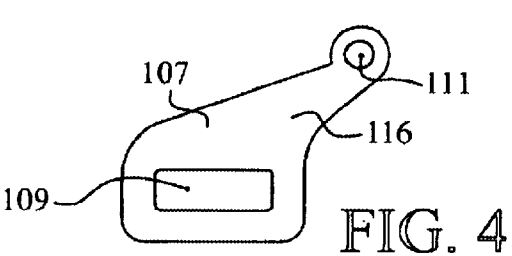
FIG. 4
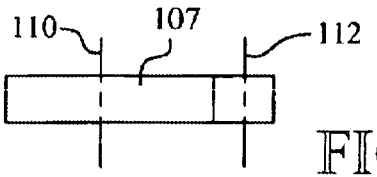
FIG. 5
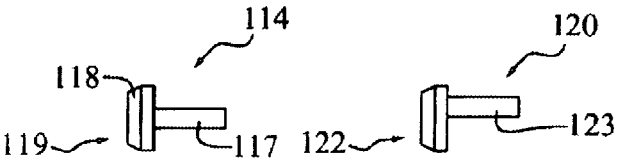
FIG. 7
FIG. 6
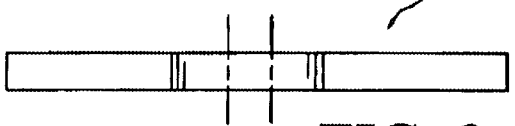
FIG. 9
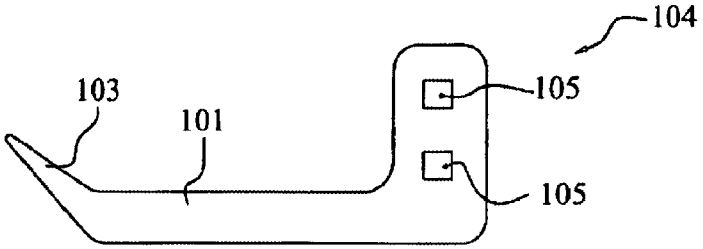
FIG. 2
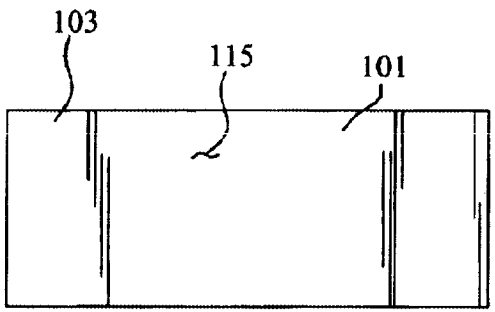
FIG. 3
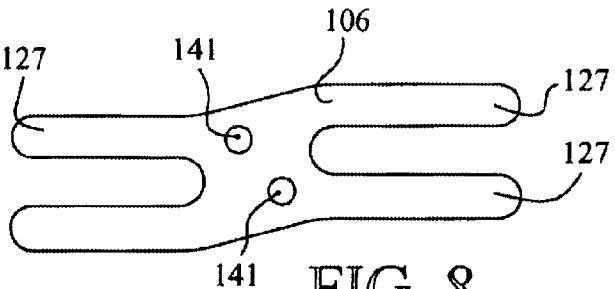
FIG. 8

ARROW REST

RELATED APPLICATIONS

This application claims the benefit under 35 U.S.C. 119(e) of the filing date of Provisional Application Ser. No. 60,325,798, filed Sep. 28, 2001, for "ARROW REST".

BACKGROUND

1. Field of the Invention

This invention relates generally to archery tackle. It is particularly directed to an improved arrow rest for an archery bow.

2. State of the Art

An arrow rest typically is used, with all types of archery bows, to support an arrow as the arrow is nocked on a bowstring, drawn, and discharged from the bow. An arrow rest preferably supports and guides the arrow, and avoids imparting undesired deflection to the arrow. In certain embodiments, an arrow rest allows passage of arrow fletching without imparting a deflection into the arrow by contact between the fletching and rest. Many arrangements have been proposed to create workable arrow rests, ranging from a simple scrap of leather padding over a shelf affixed to, or inherent in, a riser portion of a bow handle, to complex arrow rests having moving parts adapted to retract as an arrow is discharged.

It has been discovered that incorporating resilient members in an arrow rest can reduce loss of arrow shot accuracy caused by inconsistent interaction between the arrow and rest. One arrow rest incorporating flexible and resilient elements is a brush-type arrow rest, such as disclosed in U.S. Pat. No. 5,896,849 to Branthwaite, et al., which disposes multiple strands of resiliently flexible material around an arrow shaft operable to absorb nicks in an arrow shaft, and to dampen vibration imparted to the shaft of a discharged arrow. However, installing and tuning such an brush-type arrow rest, or other commercially available arrow rest, remains an undesirably time consuming chore.

In sales of archery equipment, a dealer often installs an arrow rest of a particular customer's choice on a selected archery bow. The archery dealer generally is required to adjust the installed location of the rest using tools to tighten adjustment fasteners. The customer may desire to make further adjustment to more adequately tune the bow, to provide optimum stability in flight of a discharged arrow. When target shooting, the archer would be required to employ certain hand tools to make a modification to the installed location of the arrow rest. While the present rest adjusting procedure is workable, a tool-free adjusting arrangement would be an improvement.

Despite the considerable range of developed arrow rests, a need still exists for an arrow rest that is simple, reliable, adjustable for windage in a tool-free operation, and that lends itself to reduced cost manufacturing and assembly techniques.

BRIEF SUMMARY OF THE INVENTION

The present invention provides an arrow rest for use with an archery bow. An arrow rest constructed according to the present invention includes a rest body, an arrow launcher with an arrow glide, and self-biased interface structure typically disposed between the rest body and the launcher. The self-biased interface structure disposed between the rest body and the arrow launcher holds the arrow launcher at an installed position variably locatable along a first axis of a transversely oriented shelf-like portion of the rest body, and resists displacement of the arrow launcher from the installed position. Installation of an arrow launcher onto the shelf desirably is effected in a tool-free operation. In certain cases, indicia is carried on a surface of the shelf to indicate a desired, typically "sighted-in", transverse position for the arrow launcher.

Preferred embodiments include a linkage element configured and arranged to support the rest body in a relative position with respect to an archery bow. A preferred linkage requires a single tool to effect its attachment to a rest body. The cooperating rest body carries nut holding structure and linkage gripping structure. The nut holding structure resists rotation of a nut portion of a fastener, and the linkage gripping structure resists rotation of the rest body as the rest body is attached to such a linkage bracket. Of course, the rest body may be attached directly to a riser portion of a bow handle, in certain cases.

The rest body generally includes a transverse extension member embodied as a shelf having a first axis that is oriented perpendicular to a nocked arrow supported on the arrow rest. A length of the shelf desirably has a substantially uniform cross-section to accommodate a windage adjustment of an arrow launcher supported on the shelf. The arrow launcher is adapted to hold an arrow glide for supporting an arrow shaft in a relative position with respect to the rest body shelf.

In one embodiment, the self-biased interface structure is carried by the arrow launcher and comprises a resilient element arranged for self-biased engagement with structure of the shelf. In another embodiment, the interface structure is carried by the shelf and comprises a resilient element arranged to form a self-biased engagement with structure of the arrow launcher. In any case, the self-biased interface structure desirably effects a friction-fit between the arrow launcher and the shelf. In general, the resilient element is self-biased as a result of installation of the arrow launcher onto the rest body Certain preferred arrow launchers have launcher bodies arranged to include an elastic element, comprising a first material, at a gripping interface structured to grip the shelf member. Some launcher bodies have a launcher arm projecting therefrom and arranged to dispose an arrow glide, comprising a second material, at a relative position with respect to the rest body. Certain currently preferred launcher bodies have a through-bore, or conduit, configured in harmony with a cross-section shape of the shelf to receive the shelf in journalled sliding reception inside the conduit. The elastic element is generally arranged to effect a self-biased friction fit with structure of the shelf effective to resist displacement of the launcher body from an installed position on the shelf.

An arrow rest may include a first arrow launcher having a first launcher body comprising an elastomeric material, with an elongate arm portion affixed to the launcher body and carrying an arrow glide comprising a second material and providing an arrow interface offering reduced friction to an arrow supported thereon. The rest may include a second arrow launcher structured substantially as a mirror image of the first arrow launcher, with the second arrow launcher being disposed in proximity to the first arrow launcher on the shelf. A spacing between arrow glides carried by the first and second arrow launchers may be increased to lower a stance of an arrow supported between the arrow glides.

An alternative embodiment of an arrow rest includes a left prong assembly comprising a left base and a left tip, and a right prong assembly comprising a right base and a right tip. The left and right prong assemblies are held, for tool-free elevation and windage adjustability, in a grip provided by self-biased structure of the launcher body. In such an assembly, structure of the left base and the right base can be arranged in an overlap configured to maintain the left tip and the right tip in an alignment perpendicular to an arrow shaft supported therebetween. It is preferred for that overlap section to be transversely adjustable to permit changing a spacing between the left tip and the right tip whereby to raise or to lower a stance of a supported arrow, or to effect a windage adjustment. One or more additional flexible elements may be disposed between a base and a tip of a prong assembly to provide increased flexibility at the tip to better absorb irregularities of an arrow shaft. One workable such flexible element includes a section of surgical tubing arranged as a socket in which a prong base and a prong tip may be forcibly inserted.

In a different embodiment, a first arrow launcher assembly includes a first launcher body comprising an elastomeric material arranged to grip a transverse shelf. An elevated portion of the launcher body typically carries an arrow glide comprising a second material providing an arrow interface offering reduced friction to an arrow supported thereon. Arrow glides may be arranged for plug-fit reception in receiving structure of the launcher body. Glide surfaces contacting an arrow may take any convenient form, including shapes operable to provide point, line, and patch contact between an arrow and a glide surface. Certain desirable arrow glides are fashioned as elongate arms attached to a launcher body, and carrying heads shaped as glides to support an arrow shaft. In any case, glides desirably avoid contact with arrow fletching. The arrow rest may also include a second arrow launcher assembly, constructed substantially as a mirror image to the first arrow assembly, and disposed in proximity to the first arrow launcher assembly on the shelf whereby to support an arrow between glides of the respective launcher assemblies.

Certain embodiments of arrow rests according to the invention may also include a mechanical assist device to provide a mechanical advantage operable to effect a transverse adjustment of the shelf with respect to a bow on which the arrow rest is mounted. One such mechanical assist device provides a threaded shaft adapted to convert rotation of a knob to a translation of arrow supporting structure and thereby to effect a windage adjustment.

The invention may be characterized an arrow rest for use with an archery bow. The arrow rest includes a rest body having a transverse shelf, linkage structure operable to hold the rest body in a position with respect to a bow, an arrow launcher, and a resilient element arranged to resist displacement of the launcher along the transverse shelf. Preferred linkage structure is structured in harmony with a rest body to permit forming an attachment therebetween using a mechanical fastener and only a single tool. The linkage desirably is adjustable to move an arrow glide in a direction aligned with an axis of an arrow mounted for discharge from the bow. Installing an arrow launcher onto the transverse shelf imparts a self-biased friction fit between the resilient element and the transverse shelf. Such installation desirably is effected in a tool-free operation to reduce time of assembly and attendant costs. The resilient element further permits relative motion between an arrow glide and the shelf, whereby to permit the arrow glide to deflect under the influence of a arrow discharged from the bow and to reduce vibration imparted to a discharged arrow. Certain constituent components of some arrow rests may be manufactured as sections cut from extruded stock to reduce manufacturing costs.

BRIEF DESCRIPTION OF THE DRAWINGS

In the drawings, which illustrate what are currently considered to be the best modes for carrying out the invention:

FIG. 2 is a front view in elevation of an arrow rest body portion of the arrow rest assembly illustrated in FIG. 1;

FIG. 3 is a top view of the arrow rest body of FIG. 2;

FIG. 4 is a side view in elevation of a launcher arm portion of the arrow rest assembly illustrated in FIG. 1;

FIG. 5 is a top view of the launcher arm of FIG. 4;

FIG. 6 is a top view of an arrow glide portion of the arrow rest assembly illustrated in FIG. 1;

FIG. 7 is a top view of an alternative arrow glide;

FIG. 8 is a side view of a rest body mounting bracket portion of the arrow rest assembly illustrated in FIG. 1;

FIG. 9 is a top view of the rest body mounting bracket of FIG. 8;

DETAILED DESCRIPTION OF THE ILLUSTRATED EMBODIMENTS

Figure 1:
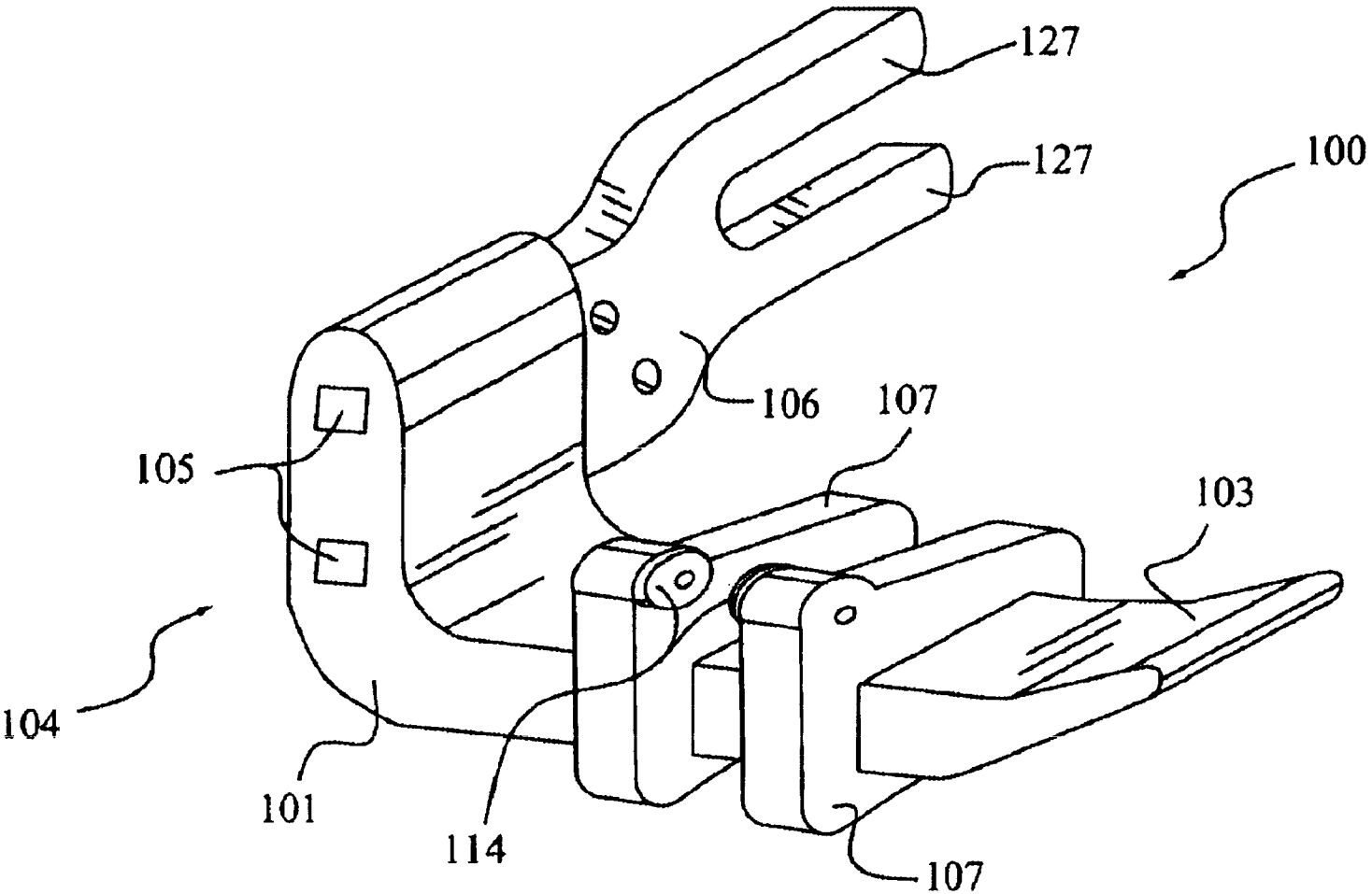
FIG. 1 is a view in perspective of a first assembled arrow rest according to the instant invention.

A first arrow rest assembly according to the instant invention, generally indicated at 100, is illustrated in FIG. 1. Components suitable for use in constructing an arrow rest assembly 100 are separately illustrated in FIGS. 2–9. FIGS. 2 and 3 illustrate details of a first workable rest body 101. A rest body 101 may include an arrow safety shelf 103, as illustrated, and typically has attach structure, generally indicated at 104, such as one or more receiving conduits 105, with which to receive mounting bracket structure for attachment of rest body 101 to a bow. Conduits 105 may be fashioned as through-bores, in certain embodiments. Attach structure 104 of the illustrated rest body 101 is adapted to form a self-biased interface between bores 105 in the body 101 and structure carried by a mounting bracket 106. Assembly of the illustrated rest body 101 to a bow mounting bracket 106 may therefore be accomplished as a press-on fit, without tools. Mounting bracket 106 is typically adapted for attaching the rest body 101 to a riser portion of a bow handle.

A rest body 101 is desirably formed from a material having damping characteristics to resist transfer of vibration between a launched arrow and the bow. Preferred rest bodies also help to attenuate vibration in the launched arrow. Desirable materials of construction of a rest body 101 include rubber (especially extrudable rubber compounds), urethanes, and other elastomers. A rest body may also be made from any other materials which provide sufficient structural support foundation to maintain arrow rest components in position. Such other materials nonexclusively include various metals including Aluminum and stainless steel, woods, and plastics.

FIGS. 4 and 5 illustrate certain details of one configuration for a launcher arm 107. Launcher arm 107 typically includes some structure, such as conduit or bore 109, adapted to interface in a sliding relationship with a rest body 101 to mount a launcher arm 107 onto a rest body 101. In the illustrated launcher arm 107, conduit 109 passes completely through launcher arm 107 along axis 110. Launcher mounting bore 109 desirably is sized to form a self-biased engagement along a length of rest body 101. Material forming launcher arm 107 desirably maintains a self-biased engagement with a rest body 101, while permitting a tool-free transverse adjustment in mounting position along an axis of rest body 101.

Still with reference to FIGS. 4 and 5, structure such as glide socket 111 oriented along socket axis 112 may be included to attach an arrow glide 114 (see FIG. 6). Glide socket 111 is illustrated as being a through-bore, although blind guide sockets 111 are also within contemplation. Alternatively, launcher arm 107 may include structure configured directly provide an arrow glide surface operable to interface with, and support, an arrow shaft during launch of the arrow. Typically, two symmetrically paired launch arms 107 are provided in an assembled arrow rest 100. However, it is within contemplation for an arrow rest, constructed according to principals of the instant invention, to include only one launcher arm 107 and a suitably shaped arrow glide. In any case, a launcher arm 107 desirably operates to help position an arrow glide structure to provide a stable support to an arrow as the arrow is held at a nock position, or is discharged from a bow. Indicia (not illustrated) may further be included on one or more surface 115 (see FIG. 3) of rest body 101 to assist in locating, or relocating, a launcher arm 107 in a desired assembled position.

Launcher arms 107 also are desirably made from materials having damping characteristics to resist transfer of vibration from a launched arrow to a bow, to reduce vibration in a poorly tuned (e.g. having too low spine stiffness) arrow, or to accommodate defects, such as nicks, in a launched arrow. Preferred launcher arms 107 also help to attenuate vibration in a launched arrow. It is currently preferred to manufacture launcher arms 107 as sections cut from fairly soft and flexible extruded material, such as silicone. Such material provides sufficient and stable support for a nocked arrow, and still permits an arm 107 to deflect or rotate whereby to accommodate imperfections in an arrow shaft, or to compensate for poor tune of the arrow and bow. The launcher arm 107 may therefore deflect (e.g. in a direction transverse to an axis of a released arrow shaft) and absorb a bump, scratch, or ding in the arrow shaft, or shaft deflections caused by factors such as improper tune of the arrow, thereby resisting a change in arrow flight from the desired sight-in arc to the point of impact. However, workable launchers may be manufactured by alternative methods, including molding and injection molding, machining, casting, and the like.

Launcher arms 107 may be made in a range of Durometers, or configured to produce a range of section bending modulus, whereby to accommodate different arrow spine tuning. Silicone type materials are particularly suitable for launcher arms 107 due to their inherent stability in flexural modulus over a wide temperature change.

A cross-section of a launcher arm 107 may incorporate additional cut-outs, or bores, as desired to achieve the desired flexibility and to minimize weight. Shapes beneficial to attenuate vibrations may be included, in certain cases. Launcher neck 116 (see FIG. 4) may be configured and arranged to function in harmony with the material of composition of a launcher arm 107 to permit a desired flexibility of the launcher arm 107 at the arrow/glide interface. For example, a launcher neck 116 may be more or less slender than illustrated, or have a different length, or be oriented to point in a different direction than illustrated. Similarly, launcher neck 116 may be configured to locate an arrow glide, such as a glide 114, in any desired position with respect to the launcher arm 107 and rest body 101.

FIG. 6 illustrates a typical arrow glide, generally indicated at 114, having a stem 117 and an arrow glide surface 118 on a button-head, generally indicated at 119. Stem 117 may be configured for press-fit reception inside bore 111 of launcher arm 107 (FIG. 4). Such a press-fit engagement permits tool-free replacement of an arrow glide 114 in the field without disturbing the point of impact of a bow on which the rest assembly 100 is mounted. Arrow glides 114 may be made from any suitable material, although a slippery interface between a glide 114 and an arrow shaft is desired. Arrow guides 114 are preferably made from a Teflon or other plastic type of material, although such is not a requirement. A plastic or Teflon glide mounted on a flexible launcher arm 107 reduces arrow mounting noise over a conventional metal rest, thereby potentially improving a hunter's chance of success in the field.

FIG. 7 illustrates one alternative arrow glide 120 having an eccentrically mounted button-head, generally indicated at 122. The eccentric button-head 122 may be rotated within a receiving socket, such as socket 111, as desired to accomplish an elevation change in a launched arrow flight path. Indicia (not illustrated) may be included to serve as a reference point and to facilitate rotational adjustment of a head 122 relative to a launch arm 107. Certain glide sockets 111 may be configured in harmony with the cross-section shape of a glide stem 123 to help index the rotation of an arrow glide 120.

FIGS. 8 and 9 illustrate an exemplary bracket 106 useful to mount a rest body 101 to a riser of a bow handle (not illustrated). Illustrated rest body mounting bracket 106 is structured to permit installation on either a right- or left-hand bow. Such a mounting bracket 106 reduces the number of parts a vendor must maintain in inventory. Receiving structure embodied as bracket arms 127 are formed to interface inside of bores 105 in a press-fit interference to hold a rest body 101 in position with respect to a bracket 106. Bracket arms 127 may be made any convenient length, and may be arranged for either a conventional draw or an overdraw. An adjustment of a location of an arrow rest 100 along an axis of a nocked arrow can be accomplished by sliding rest body 101 along the length of arms 127, as desired.

Bow attachment structure, such as one or more conduits or through-bores 129, may be provided in a mounting bracket 106 to attach bracket 106 to a riser of a bow handle. One or more fasteners (not illustrated) may be placed through one or more of conduits 129 for reception in a riser of a bow handle. Brackets 106 may be made from any suitable structural materials, including metal, plastic, or fairly hard rubber, urethane or other supportive material. It is currently preferred to form brackets 106 from cross-sections cut from extruded Aluminum stock. In fact, it is preferred to form rest body 101, launcher arm 107, and bracket 106 of the instant invention from cross-sections cut from extruded stock. Such construction permits low cost manufacture of an arrow rest assembly 100.

Figure 10:
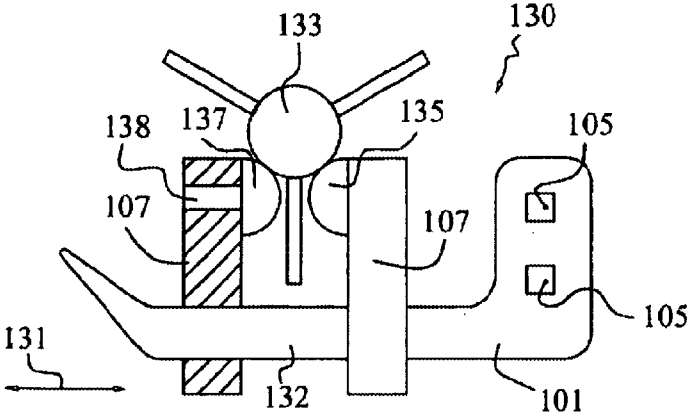
FIG. 10 is a schematic rear view, partially in section, of a second embodiment of the invention.

FIG. 10 illustrates a second arrow rest assembly according to the instant invention, generally indicated at 130. The arrow rest 130 may be assembled to form either a left- or right-hand arrow rest 130 without the use of tools. A windage adjustment may be made in an arrow's trajectory by moving one or both launcher arms 107 in transverse directions along an axis, as indicated generally at 131, of elongate shelf member 132 of the rest body 101. Elongate member 132 provides a length of structure oriented in a transverse direction and having a substantially uniform cross-section on which to receive holding structure provided by an arrow launcher, such as by an arrow launcher 107.

Continuing to refer to FIG. 10, moving the launcher arms 107 closer together increases the elevation of arrow impact since a shaft of arrow 133 is supported at a correspondingly higher elevation between arrow glides 135. In similar fashion, separating arms 107 apart from one another lowers impact of an arrow 133 by lowering a stance of the arrow between the alternatively shaped arrow glides 135 in the rest assembly 130.

As illustrated in FIG. 10, button heads 137 of arrow glides 135 have a substantially round shape atop a cylindrical stem 138. Many other shapes and configurations are workable for arrow glide heads, including heads providing beveled or alternatively shaped surfaces, or surfaces arranged for patch, line, or point contact to an arrow shaft. Similarly, structure affixing a glide head to a launcher arm may vary from the illustrated structure. It is within contemplation to fashion glide attach structure, such as stem 138, alternatively as: an adhesive patch interposed between an arrow glide and a launcher arm, a peg of any cross-section shape received in a blind socket or through hole in a launcher arm, or as structure integral to the launcher arm itself.

Arrow rest assembly 130 typically includes some attachment structure for interfacing with bracket structure for purpose of mounting the arrow rest to a bow. As illustrated in FIG. 10, one convenient structural arrangement for such mounting includes bores 105 which are structured and arranged to interface with arms 127 (FIG. 1) of bow mount bracket 106 in a press-fit engagement. The body 101 may therefore be adjusted in a longitudinal direction, as indicated generally at 139, along the length of arms 127, to provide flexibility in a front-rear direction with respect to the bow on which an arrow rest is installed.

Figure 11:
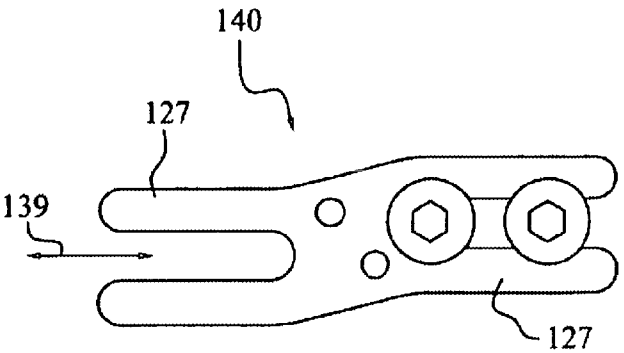
FIG. 11 is a side view of a mounting bracket having an alternative mounting arrangement for attachment to a bow riser.

One way to attach a bracket, such as bracket 106 or alternative bracket 140, to a bow is illustrated in FIG. 11 as one or more mounting bolts 141 placed between bracket arms 127. Such an arrangement permits additional longitudinal adjustment of the installed position of an arrow rest, such as arrow rest 130. An alternative attachment may be formed by placing fasteners through one or more fastener holes 142 in bracket 106 (FIG. 8). Brackets 106, 140 typically can be mounted on a bow to form either right- or left-hand arrow rest attach structure.

Figure 12:
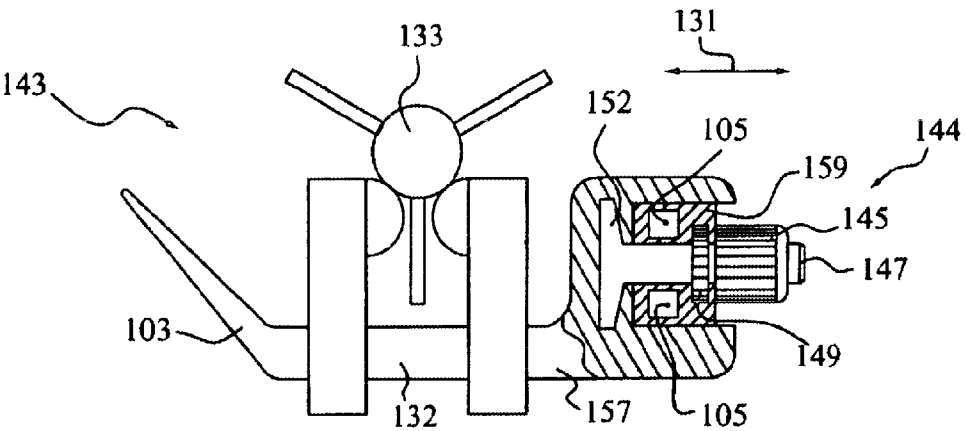
FIG. 12 is a schematic rear view, partially in section, of a third embodiment of the invention having a dial actuated windage adjustment.

It is within contemplation for a windage adjustment to be made in the instant invention by mechanical means, as an alternative to, or as well as, manually moving launcher arms 107 transversely along a body 101. Such mechanical adjusting devices may provide a more fine control over an adjustment to provide improved accuracy in adjustment of an arrow rest. FIG. 12 illustrates a third embodiment of the invention, generally indicated at 143, including one arrangement forming such a mechanical windage adjustment device, generally indicated at 144.

One windage adjustment assembly 144, providing a mechanical advantage to assist in making a windage adjustment, is illustrated in FIG. 12. Mechanical windage adjustment assembly 144 includes knurled knob 145, threaded stem 147, and fixed collar 149. Turning knob 145 drives the stem 147 side-to-side in a transverse direction 131 by way of threaded engagement between the knob 145 and stem 147. A reference anchor for relative motion of the stem 147 is provided by material trapped between knob 145 and fixed collar 149. As illustrated, carrying structure, such as an enlarged head 152 may be disposed at one end of stem 147 to carry rest body 157 in a side-to-side displacement to accomplish a windage adjustment. Body 157 may be characterized as having an 'H' shape in cross-section, and is adapted to slide with respect to intermediate block structure 159. Other mutually cooperating shapes are within contemplation to form such a sliding arrangement. Illustrated block element 159 includes one or more bores 105 adapted for press-fit engagement to arms 127 of a bracket 140, similarly to the engagement of body 101 with arms 127 of bracket 106.

Figure 13:
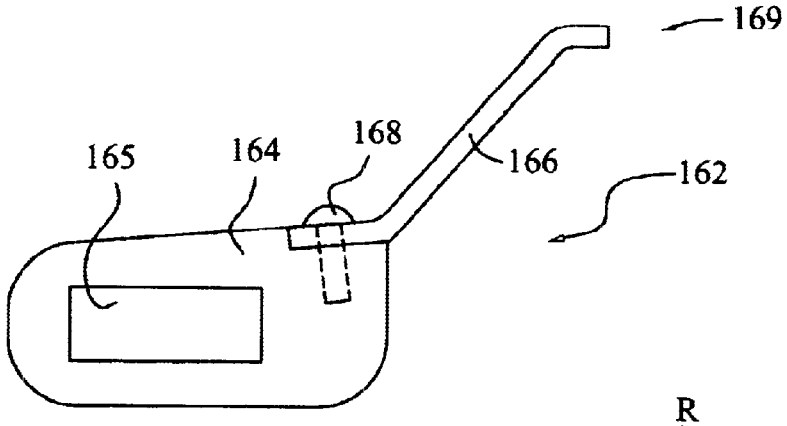
FIG. 13 is a schematic side view of a fourth arrow rest with a single-piece, tray-type arrow launcher.

FIG. 13 illustrates a launcher arm subassembly, generally indicated at 162, of an alternative arrow rest according to the instant invention. Illustrated launcher arm body 164 provides gripping structure, in the form of through-bore 165, that is adapted for engagement to a rest body, such as rest body 101, to produce an interference friction fit between the assembled components. A tray-type launcher extension 166 may be fastened to body 164 by a mechanical fastener, such as illustrated screw 168. Other fastening means are also within contemplation, including adhesive bonding, welding, and plug-fit reception between cooperating structure carried by a launcher arm body and a launcher arm. One or more launcher arm subassemblies 162 may be installed at user-selectable transverse locations on a rest body 101. A top portion of launcher arm 166, generally indicated at 169, is generally arranged to interface with an arrow shaft, and to support that shaft, while drawing and releasing an arrow.

Figure 14:
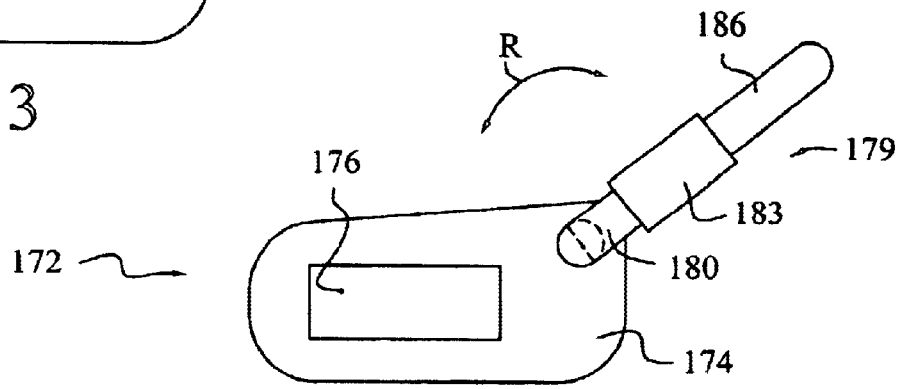
FIG. 14 is a schematic side view of a portion of a fifth arrow rest illustrating yet another alternative arrow launcher arrangement.
Figure 15:
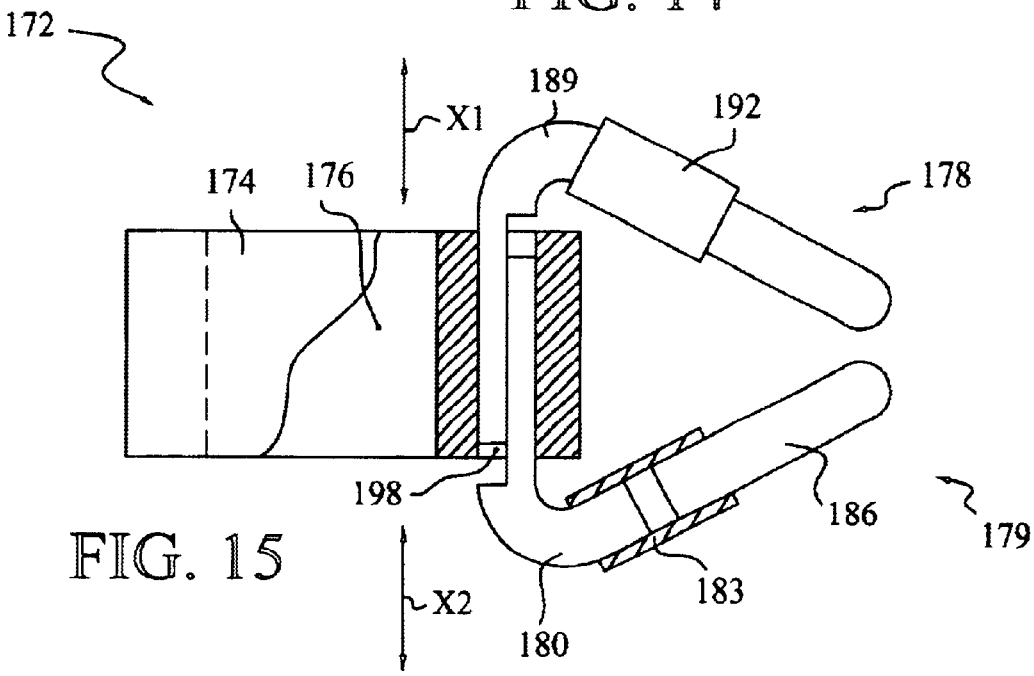
FIG. 15 is a schematic top view, partially in section, of the embodiment of FIG. 14, with the launcher arms rotated into a horizontal plane.

FIGS. 14 and 15 illustrate another alternative launcher arm subassembly, generally indicated at 172. A launcher arm body 174 of subassembly 172 provides holding structure, embodied as through-bore 176, to interfaces with a transverse member of a rest body, such as member 132 in FIG. 10. Launcher arm body 174 typically is manufactured from a resilient material, such as rubber, urethane, or silicone, to form a self-biased grip between holding structure 176 and a transverse member 132. A self-biased gripping force may also be produced in portions of launcher arm body 174 to secure other structure as well.

In the illustrated launcher arm subassembly 172, a single launcher arm body 174 supports a pair of left and right launcher prong assemblies 178 and 179 respectively. The illustrated right prong assembly 179 includes a prong base 180, a flexible coupler 183, and a prong tip 186. Illustrated left prong assembly 178 has a base 189 connected by a flexible coupler 192 to a prong tip 195. Alternatively, prong assemblies 178, 179 may be formed as unitary structure. Flexible couplers 183 and 192 permit prong tips 186 and 195 to deflect in any direction transverse to an axis oriented along a length of a respective prong tip. This tip deflection permits the arrow rest assembly 172 to at least partially absorb defects in released arrows, or undesired vibration of an arrow during the arrow shot, and thereby assist in improving arrow trajectory to a consistent target location.

Illustrated prong bases 180 and 189 are mutually adapted to form an overlapping split-cylindrical section secured by reception in body 174. On assembly to the launcher arm body 174, bases 180 and 189 are forced into overlapped reception within bore 198 through body 174. Bore 198 provides a self-biased grip to resist movement of bases 180 and 189 from the assembled position. The overlapped base sections orients tips 186 and 195 in a fixed plane, typically perpendicular to the shaft of a nocked arrow. The bases 182 and 190 may alternatively be structured and arranged, such as by not overlapping, to permit individual adjustment out of such plane. It is currently preferred to maintain the tips in a such a common plane, and permit individual base adjustment in transverse directions indicated by arrows X1 and X2. Such transverse adjustment permits adjustment of the arrow interface with tips 186 and 195, and affords some elevation control and tuning to an arrow supported between tips 186, 195. Additional elevation control may be provided by rotating prong assemblies 178 and 179 about their mutual base axis as indicated by arrow R (FIG. 14). Of course, sliding both prong bases 180, 189 in the same transverse direction with respect to a body 174 permits a windage adjustment to be made, in addition to a windage adjustment provided by sliding launcher body 174 along an axis of a transverse member of a rest body, such as body 101.

While the surfaces of bases 180 and 189 are illustrated as being substantially smooth and circular in assembled overlapping cross section, such is not a requirement. In fact, a faceted, or otherwise shaped external surface on bases 180 and 189 may be adapted to "click into place" at discrete rotations with respect to cooperating structure in bore 198. Such discrete installation locations may assist an archer in maintaining the arrow rest assembly in a sighted-in configuration subsequent to inadvertent rotation of the prong assemblies 178, 179. Indicia or simple visual inspection may assist in returning the prong assemblies 178, 179 to a desired sighted-in rotation angle with respect to the base 174.

Figure 16:
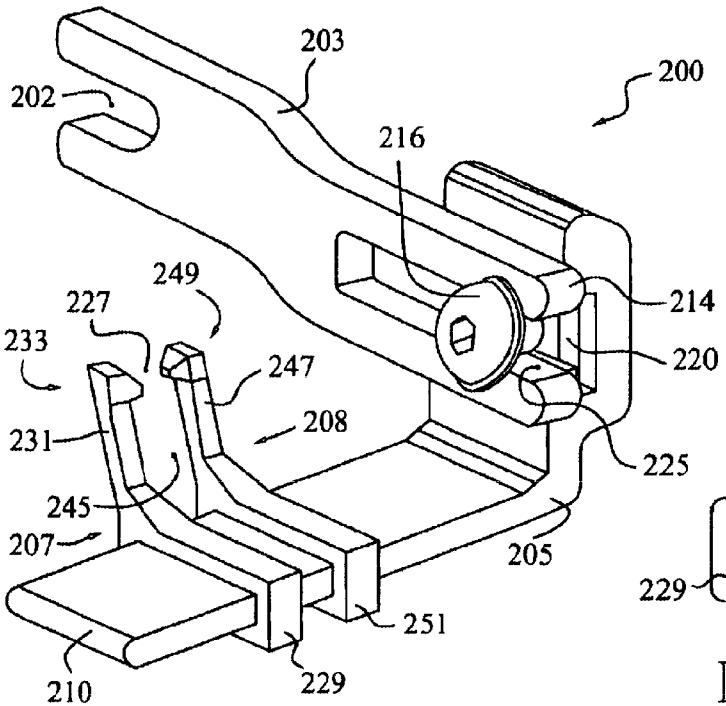
FIG. 16 is a view in perspective of a currently preferred embodiment of an arrow rest assembly ready for attachment to an archery bow.

One currently preferred embodiment of an arrow rest assembly, generally indicated at 200, is illustrated in FIG. 16. Arrow rest assembly 200 typically is attached to an archery bow by way one or more fasteners (not illustrated) arranged in slot 202 of linkage 203. The rest assembly 200 includes a rest body 205, and a pair of arrow launchers, generally indicated at 207 and 208, disposed to permit making a windage adjustment along shelf member 210 of the rest body 205.

Figure 17:
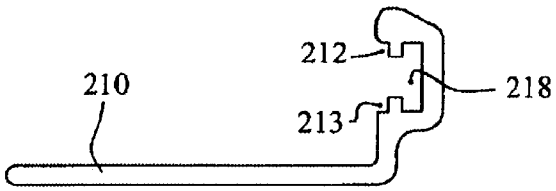
FIG. 17 is a front view of the rest body illustrated in FIG. 16.
Figure 19:
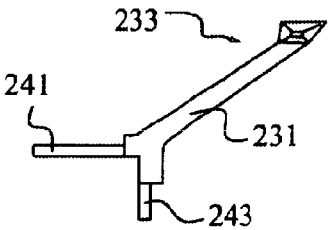
FIG. 19 is a side view of the arrow support portion of an arrow launcher illustrated in FIG. 16.
Figure 18:
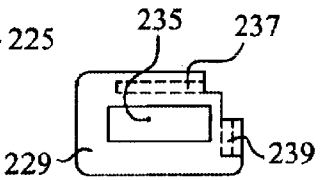
FIG. 18 is a side view of the gripping portion of an arrow launcher illustrated in FIG. 16.
Figure 20:
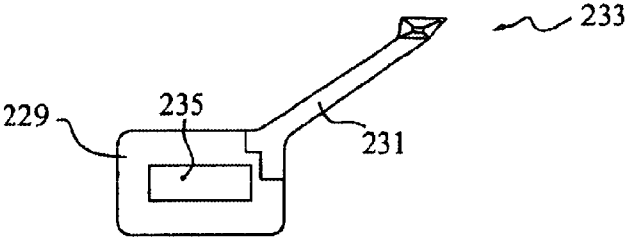
FIG. 20 is a side view of one arrow launcher assembly of FIG. 16.

Illustrated rest body 205 preferably is formed by cutting a short length from an extruded Aluminum billet. Desirably, and as illustrated in FIGS. 16 and 17, the cross-section of rest body 205 provides structure adapted to form one or more receiving areas 212 and 213 in which to receive end 214 of linkage 203. Areas 212 and 213 cooperate to form a channel. Even a single receiving area 212 or 213 forms a workable brace for linkage 203. Such structure provided by body 205 forms an interference fit between rest body 205 and linkage 203 to resist rotation between the respective components as a fastener 216 is tightened. It is also within contemplation for structure of body 205 directly to provide linkage operable to support body 205 from an archery bow. As a nonlimiting example, body 205 may simply be directly fastened to a bow riser, instead of being attached through intermediate linkage 203.

Fastener 216 may be any sort of fastener, including hex-head bolts, slot head bolts, or the illustrated socket head bolt. It also is currently preferred to provide nut holding structure 218 in a rest body 205 to facilitate assembly of a rest body 205 and a linkage 203. It is within contemplation for threads to be formed in a rest body, in addition to, or to replace a nut 220. The illustrated arrangement permits assembly of a rest body 205 to a linkage 203 using, at most, one tool. Illustrated fastener 216 and slot 225 cooperatively provide an additional adjustment in a position of arrow support zone 227 along an axis of a supported arrow.

With reference to FIGS. 16, and 18–20, arrow launcher assembly 207 includes a launcher body 229, an extended launcher arm 231, and arrow support structure, generally indicated at 233. Launcher body 229 is formed from a resilient material, such as rubber, silicone, or urethane, and carries a conduit 235 structured to form a friction-fit to shelf 210 upon assembly of launcher body 207 to a rest body 205. Pockets 237 and 239 may be provided to secure locking tabs 241 and 243, respectively, of launcher arm 231. Either or both of locking tabs 241 and 243 may be textured, or barb-shaped in cross-section, to increase holding retention in a pocket, such as pockets 237 and 239. Launcher arm 231 may be manufactured from a material having a reduced coefficient of friction compared to the material forming a friction fit between a launcher body, such as body 229, and a shelf 205. A launcher arm 231 is typically injection molded from plastic or nylon, and may be bonded to a launcher body 229 in a subsequent manufacturing operation. However, it currently is preferred to injection overmold a launcher body 229 around the locking tabs 241 and 243 of a launcher arm 231.

Arrow launcher assemblies 207 and 208 are constructed substantially as mirror images of each other. A slot 245 between the extended arms 231 and 247 is provided to receive a cock fletch of a discharged arrow. A spacing between arrow support structure 233 and 249 may be increased by separating bodies 229 and 251. Such increase in spacing is effective to lower a stance of an arrow supported in zone 227. It is within contemplation that an alternatively shaped, and single, extended arm may replace the pair of arms 231 and 247, in certain embodiments of the invention. In that case, bodies 229 and 251 would essentially be formed as a single unitary body carrying a single extended arm.

It is within contemplation to form an alternative launcher body to include a ring-like structure as an over-size conduit that is manufactured from a less resilient material, and to dispose a grommet, or other cooperating shape, of a more resilient material sandwiched between the ring-like structure and a shelf. The ring-like material can be integral with, or attached to, an extended arm, such as an arm 231. The resilient material would permit the desired easy of assembly, and provide a self-biased friction-fit to a shelf 205 upon assembly. Such an arrangement would also be adjustable to change a windage setting without requiring the use of tools. The resilient element would also permit the desired freedom of motion of the arrow support structure relative to a shelf, whereby to reduce deflections in a discharged arrow.

Alternative arrangements for arrow rests which are within contemplation in the instant invention nonexclusively include: launcher arms 107 being formed contiguously with rest body 101; alternative mutually cooperating structure, such as dovetailed engagement, between a body 157 and block structure 157; prong type launcher extensions which may be formed as unitary 'U'-shaped structure; and launcher arm extensions which may be press-fit into alternative structure, such as a channel, in a launcher arm body 174. It is further within contemplation to arrange shelf structure to provide a slot in which to receive a resilient element for generating a self-biased friction fit between the slot and structure of an arrow launcher. Resilient elements may alternatively be formed as grommets to fit in a slot, or as washers between arrow launchers and a shelf. In general, a residual compression in a resilient element, operable to form a friction-fit to resist displacement of an arrow launcher from an installed position, may be caused simply by assembly of an arrow rest; including assembly that is not tool-free. While it is currently preferred to form certain components from sections extracted from extruded stock, other manufacturing methods are feasible, including in-part: casting, machining, injection and other molding, and stamping.

What is claimed is:

1. An arrow rest for an archery bow, comprising:

an arrow rest body comprising a transverse extension member having a first axis;

an arrow launcher adapted to support an arrow shaft in a relative position with respect to said rest body; and a self-biased interface structure disposed between said extension member and said arrow launcher, said interface structure being adapted to hold said arrow launcher at an installed position variably locatable along said first axis, and to resist displacement of said arrow launcher from said installed position.

2. The arrow rest of claim 1, wherein:

installation of said arrow launcher onto said extension member may be effected in a tool-free operation.

3. The arrow rest of claim 1, wherein:

said extension member comprises a shelf oriented along said first axis, a portion of said shelf extending a length to accommodate a windage adjustment of said arrow rest, and having a cross-section of substantially uniform size; and said self-biased interface structure is carried by said arrow launcher and comprises a resilient element arranged for self-biased engagement with structure of said shelf.

4. The arrow rest of claim 3, said arrow launcher comprising:

a launcher body comprising an elastic element, comprising a first material, arranged at a gripping interface to grip said shelf member; and a launcher arm projecting from said launcher body and arranged to dispose an arrow glide, comprising a second material, at a relative position with respect to said rest body.

5. The arrow rest of claim 4, further comprising:

a conduit through said launcher body, said conduit being configured in harmony with a cross-section shape of said shelf to receive said shelf in journalled sliding reception inside said conduit; and said elastic element being arranged to effect a self-biased friction fit with structure of said shelf effective to resist displacement of said launcher body from an installed position on said shelf.

6. The arrow rest of claim 1, wherein:

said interface structure is carried by said shelf and comprises a resilient element arranged to form a self-biased engagement with structure of said arrow launcher.

7. The arrow rest of claim 1, wherein:

said self-biased interface structure effects a friction-fit between said arrow launcher and said shelf.

8. The arrow rest of claim 1, further comprising:

a linkage element configured and arranged to support said rest body in a relative position with respect to an archery bow.

9. The arrow rest of claim 1, wherein:

said rest body carries nut holding structure and bracket gripping structure, said nut holding structure being adapted to resist rotation of a nut portion of a fastener, and said bracket gripping structure being adapted to resist rotation of said rest body with respect to a bracket operable to suspend said arrow rest from an archery bow, whereby to permit attaching of said rest body to said bracket by use of a single tool to secure said fastener.

10. The arrow rest of claim 1, further comprising:

indicia carried on a surface of said shelf, said indicia being operable to indicate a desired transverse position for said arrow launcher.

11. An arrow rest for an archery bow, comprising:

a rest body comprising a transverse shelf;

a first arrow launcher comprising a launcher body and an arrow glide, said arrow launcher being arranged for adjustable reception along a length of said transverse shelf; and a resilient element effective to resist displacement of said launcher body along said transverse shelf, said resilient element being adapted to permit relative motion between said arrow glide and said transverse shelf, whereby to resist transmission of vibration between said transverse shelf and said arrow glide.

12. The arrow rest of claim 11, wherein:

an adjustment in location of said arrow launcher along said shelf may be effected as a tool-free operation.

13. The arrow rest of claim 11, wherein:

said resilient element is self-biased as a result of installation of said arrow launcher onto said rest body and operable to provide a friction grip between structure of said rest body and structure of said arrow launcher.

14. The arrow rest of claim 13, wherein:

said first arrow launcher comprises a first launcher body comprising an elastomeric material, a neck portion affixed to said launcher body carrying said arrow glide comprising a second material providing an arrow interface offering reduced friction to an arrow supported thereon.

15. The arrow rest of claim 14, further comprising:

a second arrow launcher structured substantially as a mirror image of said first arrow launcher, said second arrow launcher being disposed in proximity to said first arrow launcher on said shelf.

16. The arrow rest of claim 15, wherein:

a spacing between said first and second arrow launchers may be increased to lower a stance of an arrow supported between first and second arrow glides carried respectively by said first and second arrow launchers.

17. The arrow rest of claim 14, further comprising:

a left prong assembly comprising a left base and a left tip;

a right prong assembly comprising a right base and a right tip, wherein:

said left and right prong assemblies are held, for tool-free adjustability, in a grip provided by self-biased structure of said launcher body; and structure of said left base and said right base is arranged in an overlap configured to maintain said left tip and said right tip in an alignment perpendicular to an arrow shaft supported therebetween, said overlap being transversely adjustable to change a spacing between said left tip and said right tip whereby to raise or to lower a stance of said supported arrow.

18. The arrow rest of claim 14, wherein:

said first arrow launcher comprises a first launcher body comprising an elastomeric material, an elevated portion of said launcher body carrying said arrow glide comprising a second material providing an arrow interface offering reduced friction to an arrow supported thereon, and further comprising:

a second arrow launcher, constructed substantially as a mirror image to said first arrow launcher, disposed in proximity to said first arrow launcher on said shelf.

19. The arrow rest of claim 13, further comprising:

a mechanical assist device to provide a mechanical advantage operable to effect a transverse adjustment of said shelf with respect to a bow on which said arrow rest is mounted.

20. An arrow rest for use with an archery bow, comprising:

a rest body comprising a transverse shelf;

linkage structure operable to hold said rest body in a position with respect to said bow, said linkage being adjustable in a direction aligned with an axis of an arrow mounted for discharge from said bow;

an arrow launcher comprising a launcher body and an arrow glide, said arrow launcher being arranged for tool-free adjustable reception of a self-biased resilient element along a length of said transverse shelf; wherein:

said resilient element is structured and arranged to resist displacement of said launcher body along said transverse shelf, said resilient element further being adapted to permit relative motion between said arrow glide and said transverse shelf, whereby to permit said arrow glide to deflect under the influence of a arrow discharged from said bow and thereby reduce vibration imparted to said discharged arrow.

* * * * *